United States Patent [19]

Young

[11] Patent Number: 4,773,121

[45] Date of Patent: Sep. 27, 1988

[54] HIGH SPEED PICK-UP HEAD

[75] Inventor: Gary B. Young, Waco, Tex.

[73] Assignee: TYMCO, Inc., Waco, Tex.

[21] Appl. No.: 19,629

[22] Filed: Feb. 27, 1987

[51] Int. Cl.[4] ..... E01H 1/08

[52] U.S. Cl. ..... 15/346; 15/415 A

[58] Field of Search ..... 15/345, 346, 415 A, 15/340

[56] References Cited

U.S. PATENT DOCUMENTS

| | | | |
|---|---|---|---|
| 3,004,279 | 10/1961 | Ringer | 15/346 X |
| 3,172,143 | 3/1965 | Yucis et al. | 15/346 X |
| 3,512,206 | 5/1970 | Young | 15/346 |
| 3,662,427 | 5/1972 | Hanna | 15/346 |
| 3,755,851 | 9/1973 | Williams | 15/346 |
| 3,903,217 | 2/1976 | Hommes | 15/346 |
| 4,044,422 | 8/1977 | Larsen | 15/340 |
| 4,099,290 | 7/1978 | Hiszpanski | 15/340 |
| 4,109,341 | 8/1978 | Larsen et al. | 15/340 |
| 4,110,864 | 9/1978 | Gunnarsson | 15/340 |
| 4,359,801 | 11/1982 | Tate | 15/346 |
| 4,466,156 | 8/1984 | Blehert | 15/346 |

FOREIGN PATENT DOCUMENTS

| | | | |
|---|---|---|---|
| 950964 | 10/1956 | Fed. Rep. of Germany | 15/346 |
| 2138280 | 10/1984 | United Kingdom | 15/346 |

*Primary Examiner*—Chris K. Moore

*Attorney, Agent, or Firm*—Diller, Ramik & Wight

[57] ABSTRACT

A high-speed pick-up head includes an air pressure chamber and an air suction chamber respectively associated with an elongated blast orifice and a suction orifice. The chambers are arranged in side-by-side relationship generally normal to the direction of vehicle/pick-up head travel and have opposite first and second ends. Each chamber defines an elongated volume corresponding in length generally to the orifice associated therewith with each volume decreasing in cross-sectional area toward its closed end. Respective air inlets and air outlets of the pressure and suction chambers are opposite each other and the blast orifice can be changed in size and/or shape, preferably diverging in a direction away from the pressure chamber air inlet to maintain maximum air velocity/flow which blasts or blows sand or similar dense debris from airport runways for subsequent removal/separation at extremely high efficiencies.

40 Claims, 3 Drawing Sheets

10
DT

FIG.4
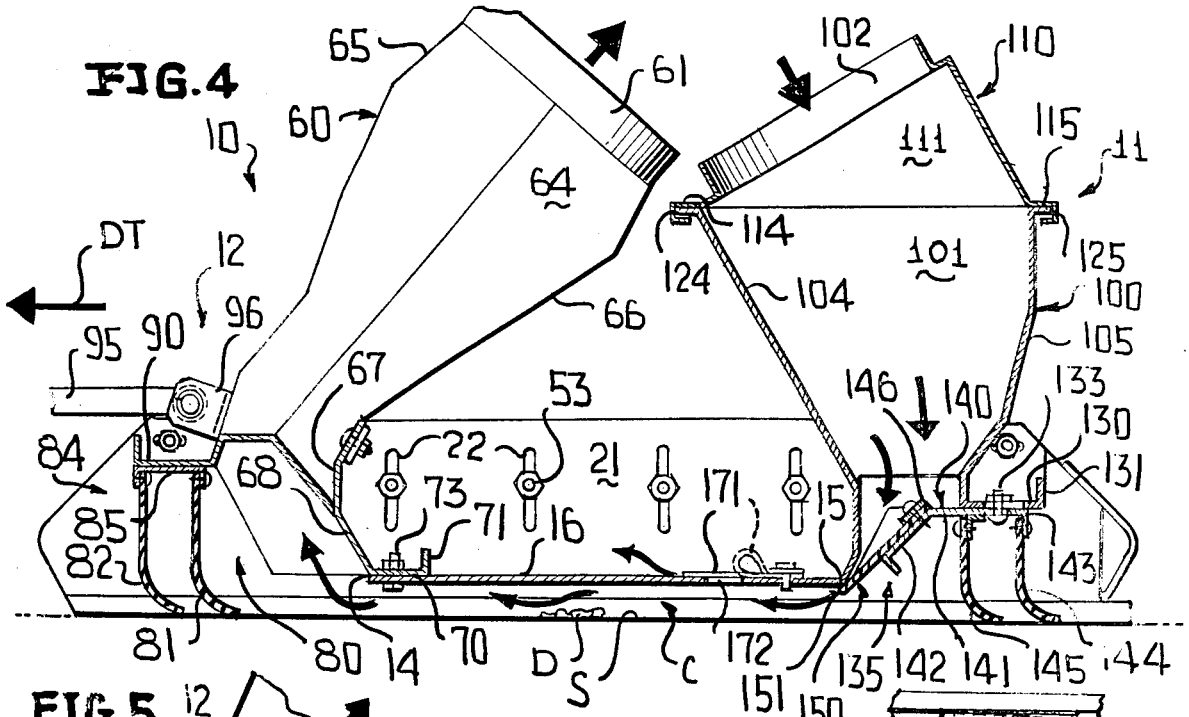
FIG.5
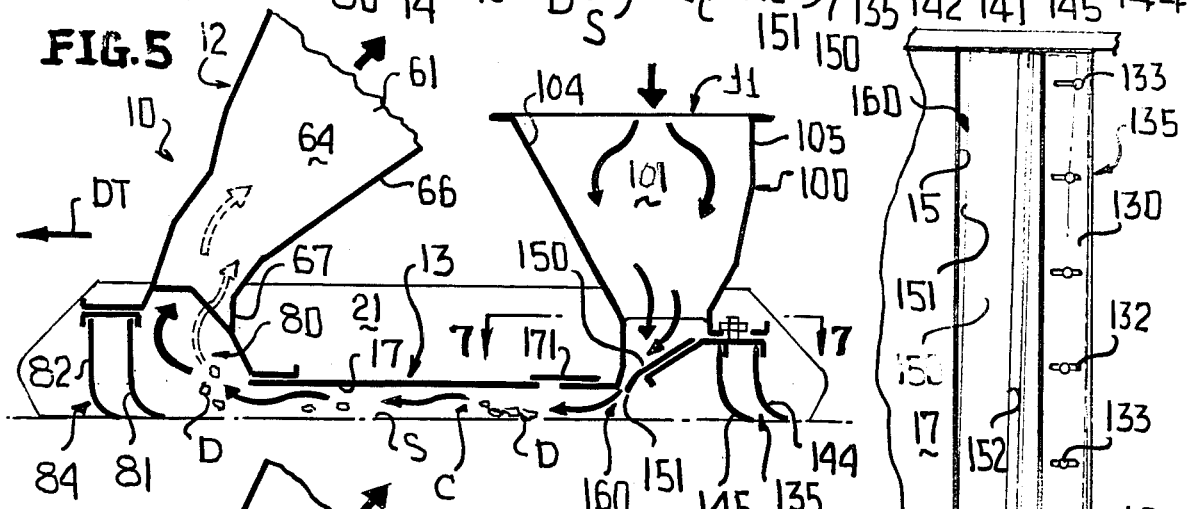
FIG.6
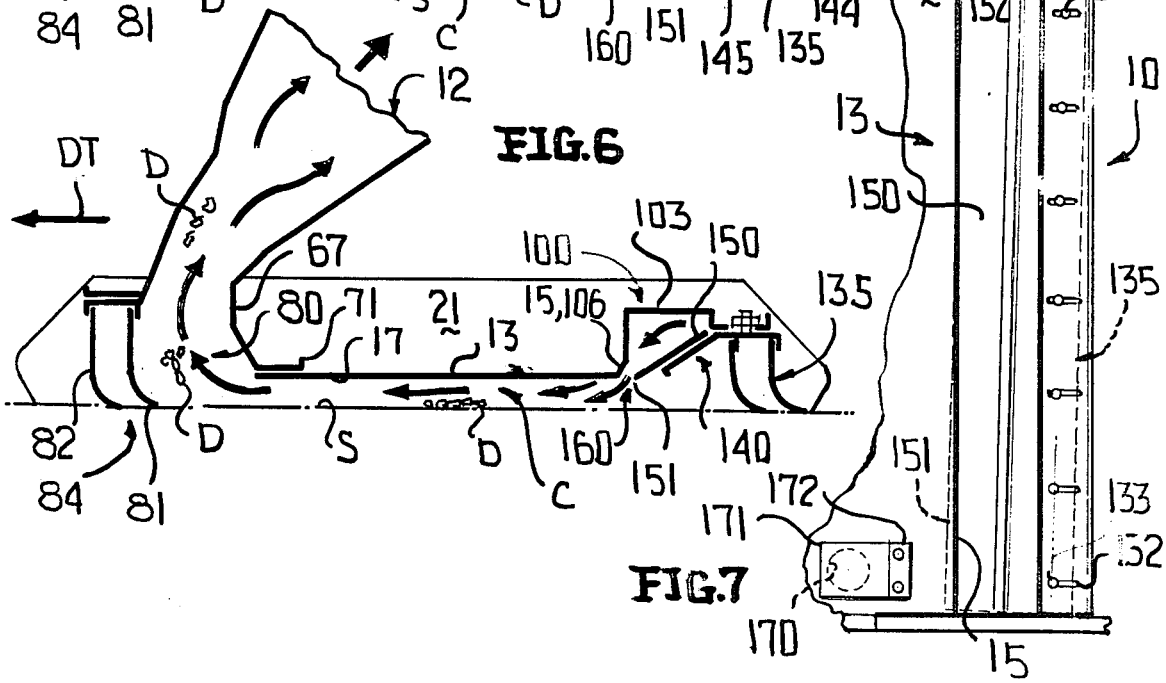
FIG.7

HIGH SPEED PICK-UP HEAD

BACKGROUND OF THE INVENTION

This invention is directed to high speed pick-up heads of the type disclosed in commonly assigned U.S. Pat. Nos. 3,512,206 and 3,545,181 in the name of Bernard W. Young issued respectively on May 19, 1970 and Dec. 8, 1970 and respectively titled AIR FLOW SURFACE CLEANING APPARATUS and AIR CLEANING APPARATUS.

The latter patents disclose a vehicle which carries a pick-up head, a centrifugal separator, a hopper, and assignee's Regenerative® air circulating system. Air generated by a turbine is directed through a blast orifice of the pick-up head, admixes with and propels the debris to a suction orifice of the pick-up head after which the debris is centrifugally separated and discharged in the hopper, and the air returns to the blast orifice. In this manner debris on roads, roadways, packing lots or the like can be rapidly and efficiently removed. However, while the apparatus of the latter patents represented state-of-the-art at the time of patenting and continues to do so to date, continued experimentation, research and development has resulted in yet greater efficiency and higher speeds of both debris removal and vehicle travel. Furthermore, the art of road sweepers has advanced considerably since the early 1970's and has become considerably more sophisticated and specialized. It is particularly because of these reasons that the present invention has been developed.

SUMMARY OF THE INVENTION

The present invention is directed to a high speed pick-up head which is of an extremely simple and straightforward construction utilizing minimal components; aerodynamic shape, construction and orientation of air pressure and air suction chambers, selective blast orifice adjustment, and minimum pick-up head to ground clearance to maximize blast air velocity which collectively assure that debris, particularly small high-mass debris, such as grains of sand, pebbles, pea-gravel or the like can be cleaned from surfaces, specifically and particularly airport runways.

In accordance with the foregoing, the novel high-speed pickup head of this invention includes an air pressure chamber and an air suction chamber respectively associated with a blast orifice and a suction orifice, the air pressure chamber and air suction chamber being positioned in side-by-side relationship generally normal to the direction of vehicle/pick-up head travel, the chambers having opposite first and second ends, each chamber defining an elongated volume corresponding in length generally to the orifice associated therewith with each chamber volume decreasing in cross-sectional area toward a closed end of the associated chamber, and the air pressure chamber having an air inlet at an end thereof opposite to an air outlet of the suction chamber.

The novel high speed pick-up head of this invention further includes means for varying the shape and/or size of the blast orifice to maintain generally uniform high speed velocity across the length thereof whereby maximum debris entrainment will occur for virtually any cfm (cubic feet per minute) of air flow created by an associated blower or turbine, and the blast orifice adjustment preferably creates a blast orifice of a generally diverging configuration in a direction away from the air pressure chamber air inlet toward the opposite closed end thereof.

In further accordance with this invention the high speed pick-up head includes a relatively flat top plate which is supported by side skid plate assemblies at a minimum distance above a surface which is to be cleaned of debris whereby maximum air movement is created between the blast orifice and the suction orifice thereby creating high speed air propulsion which blasts or blows sand, small heavy or dense pebbles or stones, chips or the like from a surface, such as an airport runway, or small stones or chips associated with so-called chip-seal programs of roads enabling corresponding high speed vehicle movement during debris removal and consequent increased efficiency.

The head speed pick-up head of the invention further includes a drain opening in a top plate or wall of the overall pick-up head assembly for cleaning debris therefrom by a simple flushing operation.

With the above and other objects in view that will hereinafter appear, the nature of the invention will be more clearly understood by reference to the following detailed description, the appended claims and the several views illustrated in the accompanying drawings.

BRIEF DESCRIPTION OF THE DRAWINGS

FIG. 4 is an enlarged cross-sectional view taken generally along line 4—4 of FIG. 2, and illustrates the manner in which high pressure air is delivered to the blast orifice, travels from right-to-left along the surface to be cleaned, and is drawn with entrained debris into the suction orifice.

FIG. 5 is a diagrammatic cross-sectional view taken generally along line 5—5 of FIG. 2, and illustrates the smaller end of the elongated blast orifice formed by a flexible blast curtain which is forced open by the air pressure adjacent the air pressure inlet of the air pressure chamber.

FIG. 6 is a diagrammatic cross-sectional view taken generally along line 6—6 of FIG. 2, and illustrates the larger size of the blast orifice a the end of the pressure chamber remote from the air pressure inlet thereof.

FIG. 7 is a fragmentary cross-sectional view taken generally along line 7—7 of FIG. 5 with parts removed for clarity, and illustrates the manner in which the blast orifice opens in a diverging direction away from the air inlet of the air pressure chamber.

DESCRIPTION OF THE PREFERRED EMBODIMENTS

Figure 1:
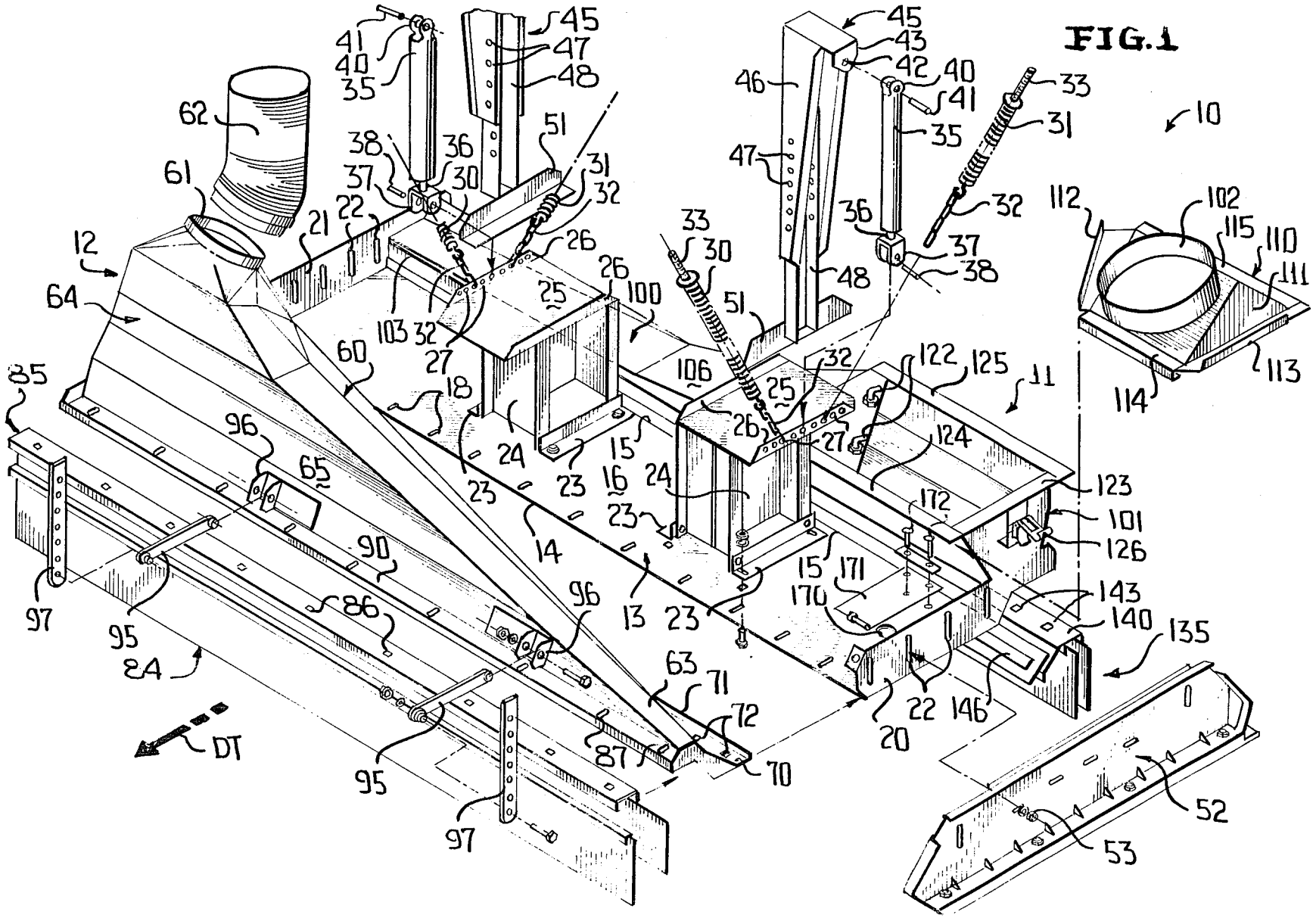
FIG. 1 is an exploded perspective view of the high speed pick-up head of this invention, and illustrates a suction head assembly and its associated tapering suction chamber, a pressure chamber assembly and its associated tapering air pressure chamber, a generally horizontal plate of the pressure chamber, and suction and blast orifices assemblies thereof.

A novel high-speed pick-up head of this invention is generally designated by the reference numeral 10 and includes an air pressure chamber assembly 11 and a suction head assembly or air suction assembly 12.

The air pressure chamber assembly 11 includes a relatively rigid rectangular metallic plate 13 having a forward longitudinal edge 14, a rear bent edge or bend 15, opposite transverse edges (unnumbered), an upper surface 16 (FIGS. 1 and 2) and a lower surface 17 (FIGS. 3 through 7). The forward edge 14 includes a plurality of spaced elongated slots 18 for securing the suction head assembly 12 thereto, as will be more apparent hereinafter. Upstanding side plates 20, 21 (FIG. 1) having vertical slots 22 are welded to the transverse or side edges of the plate 13.

The plate 13 has bolted thereto four identical up-stop tabs or L-shaped brackets 23, and between and connected to associated pairs of the up-stop tabs 23 are up-stop tower assemblies 24, each having an uppermost generally horizontal up-stop plate 25, and opposite generally parallel upstanding flanges 26 of which at least one flange has a plurality of openings 27.

The plate 13 is reciprocally, suspendingly supported beneath a vehicle (not shown) in the manner fully disclosed in the latter-identified patents, such that the forward edge 14 leads the rear edge 15 in the direction of vehicle travel which is generally designated by the headed arrow DT in FIG. 1. In the operative or running position of the high speed pick-up head 10 (FIGS. 4 through 6) the plate 13 is in intimate spaced relationship from the surface S which is being cleaned of debris D. In this position the high speed pick-up head 10 is resiliently suspended from the vehicle (not shown) by conventional flexible supports in the form of front springs 30 (FIG. 1) and rear springs 31, each connected by a chain link 32 to the holes 27 in the flanges 26 of the up-stop tower assemblies 24. Ends of the springs 30, 31 remote from the chain links 32 have threaded ends 33 which are received in apertures (not shown) or brackets (also not shown) welded to the vehicle and secured thereto by nuts (not shown).

The high speed pick-up head 10 is moved between raised and lowered positions by a pair of identical lift cylinders 35, each having a rod 36 connected to a clevis or bracket 37 which is in turn connected to a pin 38 to an associated one of the holes 27 of the upstanding flanges 26 of the up-stop tower assemblies 24. Each cylinder 35 is also connected by a bifurcated end 40 and a pin 41 to an aperture 42 of a downwardly directed bracket 43 of an up-stop assembly 45. Each up-stop assembly 45 includes a channel member 46 having a plurality of openings 47 in opposite side walls (unnumbered) thereof for connection to the frame of the vehicle. The channel member 46 is welded to a leg 48 having a lower foot 51 positioned at a specific distance below the vehicle from and above the plates 25 of the upstop tower assemblies 24 when the rods 36 are projected out of their associated cylinders 35 in the running or lowered position of the high speed pick-up head 10 (FIGS. 4 through 6). However, when the rods 36 are drawn into the cylinders 35, the pick-up head 10 is lifted until the feet 51 bottom against the plates 25 of the up-stop tower assemblies 24 to thereby hold the pick-up head 10 rigidly against the up-stop assemblies 45 for high speed vehicle travel in the raised or inoperative position of the pick-up head 10.

Conventional skid plate assemblies, plates or skids 52 are connected by a plurality of nuts and bolts 53 to the slots 22 of the side plates 20, 21 to hold the plate 13 of the pick-up head 10 a predetermined distance above the surface S, as is most readily apparent from FIG. 4 of the drawings, and define therewith a working chamber or pick-up head chamber C.

Figure 2:
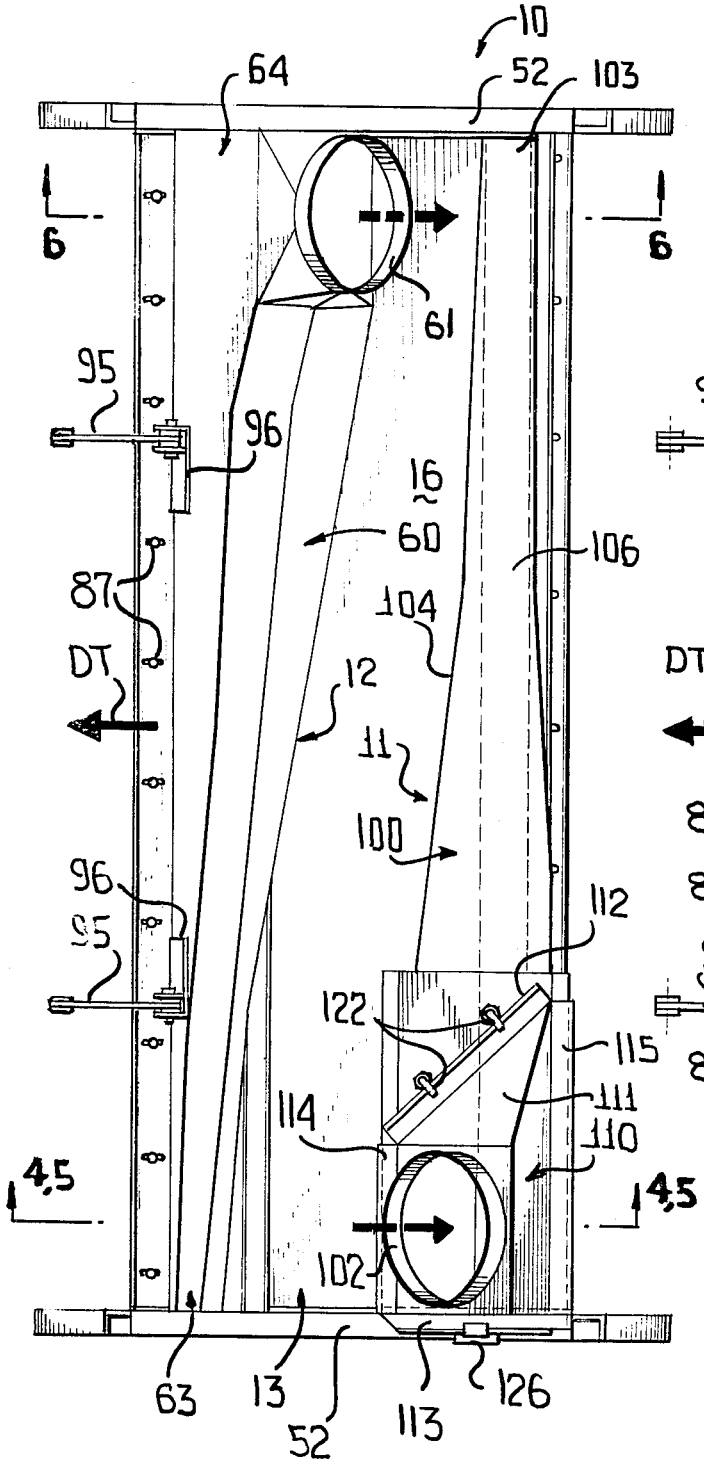
FIG. 2 is a top plan view of the high speed pick-up head, and ilustrates the manner in which the air pressure chamber and suction chamber taper from maximum to minimum cross-sectional area in opposite directions with the respective pressure inlet and suction outlet thereof being remote from each other and at the larger volumed ends of the associated chambers.

Reference is made particularly to FIGS. 1, 2 and 4 of the drawings in which the suction head assembly 12 is shown, and includes an elongated air suction chamber 60 having an air outlet or air suction outlet 61 of a generally circular configuration to which is conventionally attached a suction hose 62 which is in turn connected to the centrifugal separation chamber (not shown) of the vehicle, as in the latter-identified patents. The suction chamber 60 includes a first closed end portion 63 and a relatively larger second end portion 64 defining therebetween and therewith a generally elongated volume which decreases progressively in cross-sectional area from the largest volume at the end portion 64 and the suction outlet 61 toward the smallest volume at the closed end or end portion 63. A forward side wall 65 (FIG. 4) and a rearmost side wall 66 converge downwardly, as is best shown in FIG. 4. The rearmost side wall 66 merges with an angularly bent plate formed of a plurality of plate portions 67, 68, 70 (FIG. 4) with the latter having an upwardly directed reinforcing flange 71. The plate portions 67, 68 and 70 and the flange 71 extend the entire length of the suction chamber 60, generally corresponding to the length of the plate 13. Furthermore, the plate portion 70 has a plurality of openings 72 spaced from each other the same distance as the distance between the slots 18 so that appropriate nuts and bolts 73 (FIG. 4) can removably connect the suction head assembly 12 to the upper surface 16 of the plate 13 along the forward edge 14. The juncture between the plate portions 68, 70 (FIG. 4) is generally in alignment with the forward or leading edge 14 of the plate 13 and collectively define the rearmost edge (generally at 14) of an air suction or suction orifice 80 which extends the length of the underside of the suction chamber 60 generally between the side plates 20, 21. The size of the suction 80 can be varied in a limited fashion in the transverse direction or direction of vehicle travel DT by simply loosening the nuts and bolts 73 and shifting the entire suction head assembly 12 to the right, as viewed in FIG. 4, which will move the junction between the plates 68, 70 to the right of the edge 14 of the underlying plate 13. In this fashion the edge 14 effectively restricts the transverse size of the suction orifice 80. The opposite side of the suction orifice 80 is defined by a curtain 81 of a pair of curtains 81, 82 which likewise run the length of the suction head assembly 12 and are part of a suction head curtain assembly 84 (FIG. 1).

Figure 3:
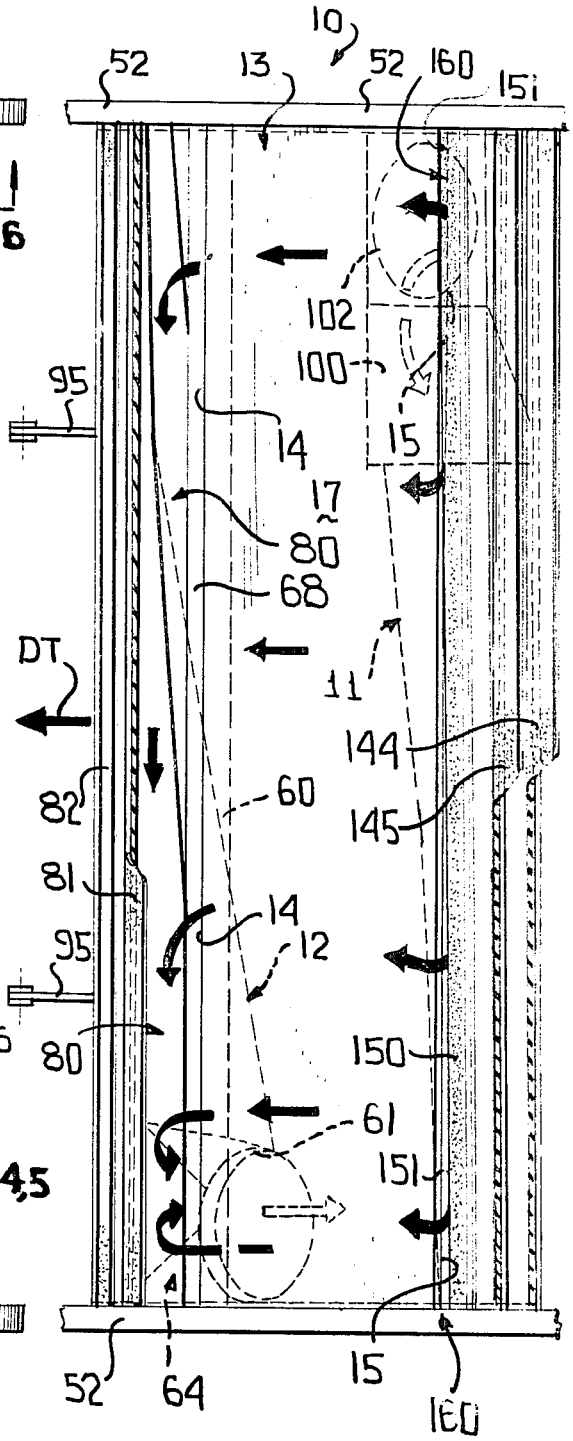
FIG. 3 is a bottom plan view of the high speed pick-up head and more clearly illustrates the blast orifices on the right, the suction orifice on the left, and a relatively flat plate therebetween.

The suction head curtain assembly 84 includes an elongated bar 85 of a generally shallow inverted U-shaped configuration having a plurality of holes 86 which are aligned with holes 87 in a forward plate or flange 90 of the suction head assembly 60. Suitable nuts and bolts can thereby secure the bar 85 to the underside of the flange 90, as is most readily apparent from FIG. 4. The curtain 81 is connected by nuts and bolts to one depending leg (unnumbered) of the bar 85 while similar nuts and bolts connect the curtain 82 to the remaining depending leg or flange of the bar 85, again as is most evident in FIG. 4. As the pick-up head 10 moves in the direction DT in FIG. 4, the lower ends (unnumbered) of the curtains 81, 82 deflect or curve, and this curvature of the curtain 81 provides a relatively smooth transition for air flow into the orifice 80 along the entire length thereof (FIG. 3).

The pick-up head 10 is preferably articulately connected to the vehicle through a pair of drag links 95 having opposite ends conventionally pivotally connected to brackets 96 fixed to the forwardmost wall 65 of the suction chamber 60 and apertured extension links 97 (FIG. 1) having upper ends welded or otherwise connected to the vehicle frame. The articulated connections permit the vehicle to pull the pick-up head 10 in the direction DT (See FIG. 4) without placing excessive strain upon the lift cylinders 35 or the springs 30, 31.

The pressure chamber assembly 11 is similar in construction to the suction chamber assembly or suction head assembly 12 and includes a pressure chamber 100 which is in generally sid-by-side relationship to the suction chamber 60, as is most readily apparent from FIG. 2 of the drawings. The pressure chamber 100 includes a relatively large volume first end portion 101 adjacent a high pressure air inlet 102 and a second low volume and closed end portion 103 (FIGS. 1 and 2). An upwardly bent forwardmost wall portion 104 of the plate 13 and a rearmost wall 105 of the pressure chamber 100 taper convergingly downwardly and with an upper wall 106 (FIG. 2) taper generally from the end portion 101 toward the end portion 103 in a progressively decreasing cross-sectional area of chamber volume. The plates 20 and 21 close and are also welded to the end portions 103, 101 of the pressure chamber 100, as is readily apparent from FIG. 1.

The high pressure air inlet 102 is preferably part of a removable pressure lid assembly 110 (FIGS. 1, 2 and 4) which includes a generally truncated roof-like top wall 111 merging at opposite ends in two upstanding flanges 112, 113 and at opposite sides in opposing flanges 114, 115 (FIG. 4). At the second end portion 101 the pressure chamber 100 includes a pair of inverted L-shaped keepers 122 (FIGS. 1 and 2), and opposite horizontal flange 123 (FIG. 1), and a pair of generally parallel oppositely directed lateral flanges 124, 125 (FIGS. 1 and 4). A conventional keeper or catch 126 is connected to the side plate 20. The removable pressure lid assembly 110 is mounted atop the end portion 101 of the pressure chamber 100 by simply sliding the same from right-to-left in FIG. 1 until the flange 112 seats beneath the keepers 122 (FIG. 2). The catch 126 is then simply engaged with the flange 113 to lock the pressure lid assembly 110 upon the inlet end portion 101 of the high pressure chamber 100.

As is best illustrated in FIGS. 4 and 7, the rearmost wall 105 is bent at its lowermost longitudinal edge (unnumbered) into a horizontal plate 130 (FIGS. 4 and 7) having an upwardly directed reinforcing flange 131 (FIG. 7). The plate 130 also includes a plurality of elongated slots 132 to which a blast orifice assembly 135 (FIG. 1) can be adjustably connected by a series of nuts and bolts 133 to permit the overall blast orifice assembly 135 to be shifted forwardly or rearwardly, either perfectly normal to or at an angle relative to the direction of travel DT for a purpose and function to be described more fully hereinafter.

The blast orifice assembly 135 includes a stepped bar 140 having a horizontal portion 141 and an angled portion 142, both of which are reinforced by flanges (unnumbered in FIG. 4) generally normal thereto. The horizontal portion 141 of the bar 140 has a plurality of openings 143 (FIG. 1) spaced along the length thereof corresponding to the slots 132, and it is through these openings and slots that the nuts and bolts 133 unite the bar 140 to the plate 130 of the pressure chamber 100. The bar 140 runs the entire length of the pressure chamber 100 and carries at its underside two flexible curtains 144, 145 whose lower end portions (unnumbered) are deflected as best illustrated in FIG. 4 during the motion of the pick-up head 10 in the direction DT.

The portion 142 of the bar 140 of the blast orifice assembly 135 is disposed at an angle to the horizontal or surface S and secured thereto by a clamping bar 146 (FIG. 1) and a plurality of bolts (unnumbered) spaced therealong is a flexible blast orifice curtain 150 which extends the length of the pressure chamber 100 and defines an elongated blast orifice or air outlet orifice 160 which similarly extends the length of the pressure chamber 100. Reference is particularly made to FIG. 7 which illustrates the blast orifice curtain 150, as viewed from above, with the clamping bar 146 and the nuts associated therewith removed for purposes of clarity. The blast orifice curtain 150 includes a forwardmost longitudinal edge 151 and an opposite rearmost parallel edge 152. It is to be particularly noted from the upper portion of FIG. 6 that the forwardmost edge 151 of the air blast curtain 150 sets off with the bent edge 15 a portion of the blast orifice 160 which converges from top to bottom in FIG. 7 or converges in a direction toward the pressure inlet end portion 101 and slightly underlyingly overlaps the bent edge 15 at the bottom end portion of FIG. 7. This angular relationship of the edge 151 of the blast orifice assembly 135, as is readily apparent from FIG. 7, noting that the bolt 133 is at the left-hand end of the lowermost slot 132 and is at the right-hand end of the uppermost slot 132. The purpose for the progressive diverging of the blast orifice 160 in a direction toward the suction side or away from the pressure side or pressure inlet 102 is to assure that generally constant air flow is created along not only the length of the pressure chamber 100 but through the blast orifice 160 over its entire length so that the air flow across and transverse to the length of the plate 13 along the surface 17 is of a uniform velocity assuring that all debris D will be "blasted" by the air flow toward and into the suction orifice 80 of the suction chamber 60. As is most apparent from FIGS. 4 and 5, the high pressure air being introduced into the high pressure inlet portion 101 of maximum crosssectional area is directed both downwardly, and due to the smooth tapered transition of the air pressure chamber 100, in a direction from the large cross-sectional area air inlet portion 101 toward the opposite smallest cross-sectional area closed end portion 103. The high pressure air at the air inlet portion 101 directly impinging upon the upper surface of the blast curtain 105 deflects the same away from the edge 15 essentially "opening" the blast orifice 160 (FIG. 5) at the high pressure end portion 101 of the pressure chamber 100. At the same time the air is forced along the air pressure chamber 100 toward the closed end portion 103, and at the latter end portion the blast orifice 160 is already "open" (FIG. 6 and upper end of FIG. 7), thus offering less resistance of high pressure air flow toward the open portion of the blast orifice 160 (upper half of blast orifice 160 of FIG. 7). Accordingly, by selectively orienting the edge 151 of the blast curtain 150 relative to the edge 15, the velocity of the air exiting the orifice 160 transversely thereto and transversely to the plate 13 can be regulated and, most importantly, can be maintained at a generally constant flow rate across the entirety of the plate 13. Accordingly, due to the uniform velocity of the air flow between the side plates 20, 21 in the direction DT, any debris D beneath the plate 13 between the side plates 20, 21 will be subject to substantially uniformed air velocity and, thus, "blasted" from right-to-left in FIGS. 4 through 6 across the working chamber C toward and into the suction opening 80 for centrifugal separation and eventual continuous recirculation of the air back through the air pressure inlet 102. Thus, the combination of the progressively decreasing cross-sectional area/tapering of the air pressure chamber 100 from the pressure inlet side 101 toward the closed end portion 103 together with the divering nature of the blast orifice 160 in the same direction (from the side 20 toward the side 21 or from the high pressure inlet 101 toward the closed end portion 103) assures uniform high velocity air flow virtually in a uniform transverse curtain or parallel streams, as indicated by the headed arrows shown in FIG. 3 in somewhat parallel relationship, along the surface 17 of the plate 13.

Furthermore, it is readily apparent that though the air velocity exiting the blast orifice 160 is uniform along its length, without assurance of corresponding withdrawal of air through the suction orifice 80, the flow path across the surface 17 will be disturbed. Accordingly, to assure that such counter-balancing of air exiting the blast orifice 160 and entering the suction orifice 80, the tapering of the suction chamber 60 is the reverse of that of the pressure chamber 100, as is also readily apparent in FIGS. 1, 2 and 3. Thus, maximum and uniform withdrawal of air and entrained debris is assured as pressurized air circulation continues. Furthermore, as noted heretofore, the nuts and bolts 73 of the suction head assembly 12 can be appropriately manipulated to vary the size and shape of the suction orifice 80 as defined between the edge 14 of the plate 13 and the curtain 81. Obviously, this change in size can be uniform by maintaining the edge 14 generally parallel to the curtain 81 or cocked thereto.

Obviously, the ede 151 of the blast orifice curtain 150 need not be "cocked", as shown in FIG. 7, but can be uniformly spaced from and parallel to the edge 15. Furthermore, the edge 151 need not be spaced partially or entirely from the edge 15 but might, for example, be tapered divergingly the entire distance from bottom to top (as viewed in FIG. 7) so that the curtain 150 would be deflected to a minimal degree at the high pressure inlet portion 101. Thus, rather than the cross-over of the blast orifice 160 shown in FIG. 7 with the edge 15 essentially underlying half the edge 15 and being spaced from the other half, the blast orifice 160 could be virtually a completely opened triangular orifice converging completely from top to bottom, as viewed in FIG. 7. If, of course, the edges 151 and 15 were spaced completely from each other and in parallel relationship to each other, the orifice 160, instead of being generally triangular, would be generally polygonal or rectangular. Obviously, the purpose of the variation and the orientation of the blast orifice curtain 150 is to assure that the air exiting along the length of the blast orifice 160 is of both maximum and uniformed velocity across the surface 17 from end to end (between side walls 20 and 21) to assure maximized motion of the debris, particularly in the case of gravel, sand or the like on runways of airports which heretofore has proved a most difficult problem for "conventional" pick-up heads at high speeds. It is for this reason also that the surface 17 of the plate 13 is spaced extremely close (approximately 2 inches) from the surface S and is virtually perfectly horizontal and flat so that the air flow/pressure/velocity is maximized to "blast" the debris D along the surface S toward and into the suction opening 80 across the working chamber C.

It will be readily apparent from the drawings that the construction of the pick-up head thus far described sets-off a generally upwardly opening volume (unnumbered) defined by the side walls 20, 21 (FIG. 1) and the area between the pressure chamber assembly 11 and the suction head assembly 12 or, stated otherwise, the area above the plate 13. During continuous high-speed vehicle travel and operation, debris D will settle and accumulate upon the plate 13. Means 170 is provided in the plate 13 in the form of a circular hole which is normally closed by a flexible rectangular curtain or flap 171 fixed to the plate 13 by a plate and bolts collectively identified by the reference numeral 172 in FIG. 1. When the pick-up head is in operation, the inherent flexibility of the drain curtain 171 is sufficient to resist upward deflection and in actual practice has been found to be an excellent over-pressure release should, for example, the suction orifice 80 become clogged during operation. In such cases limited air can escape through the hole 170 as the drain curtain 171 is deflected upwardly, as indicated by the unnumbered headed arrow associated therewith in FIG. 4. However, while this release of over-pressure in the pick-up head chamber (C, FIG. 4) beneath the plate 13 is highly desirable, it is not totally necessary, and the main purpose for the hole 170 and the curtain 171 is simply to permit flushing of debris from the upper surface 16 of the plate 13 by directing a stream of water thereupon with, of course, the free edge (unnumbered) of the curtain 171 held up or underfolded, as indicated in phantom outline in FIG. 4. In either case a stream of water from a hose directed upon the surface 16 will flush debris therefrom into and through the hole 170 and into the pick-up head chamber C.

Although a preferred embodiment of the invention has been specifically illustrated and described herein, it is to be understood that minor variations may be made in the apparatus without departing from the spirit and scope of the invention, as defined in the appended claims.

I claim:

1. A pick-up head adapted for movement along a predetermined path of travel for removing debris therealong comprising means for defining an elongated air outlet orifice through which air is caused to travel, means for defining an elongated air inlet orifice into which air and debris are drawn upon movement of the pick-up head along the predetermined path of travel, said air outlet orifice and air inlet orifice being disposed generally transverse to the predetermined path of travel, air pressure chamber means extending along said air outlet orifice for directing air under pressure to, along and through said air outlet orifice, air suction chamber means extending along said air inlet orifice for drawing air and debris into, through and along said air inlet orifice, said air pressure chamber means and air outlet orifice each having generally opposite first and second end portions, said first end portions being generally adjacent each other and being generally spaced from their respective second end portions, said air pressure chamber means first end portion defining an air inlet, said air pressure chamber means defining an elongated volume corresponding in length generally to said air outlet orifice, said pressure chamber means and said air outlet orifice being disposed generally entirely at one side of a plane through said pick-up head which is normal to the predetermined path of travel, said air suction chamber means and air inlet orifice being disposed generally entirely at a second side of said last-mentioned plane opposite said one side, and the cross-sectional area of said volume of said air pressure chamber means generally decreases in size from said air inlet toward said air pressure chamber means second end portion thereby creating air flow over the length of said air outlet orifice.

2. The pick-up head as defined in claim 1 wherein said air suction chamber means second end portion defines an air outlet, said air suction chamber means defines an elongated volume corresponding in length generally to said air inlet orifice, and the the cross-sectional area of said volume of said air suction chamber means generally decreases in size from said air outlet toward said air suction chamber means first end portion thereby creating air flow over the length of said air inlet orifice.

3. The pick-up head as defined in claim 2 wherein the cross-sectional area of the said air pressure chamber means volume decreases progressively in a tapering fashion.

4. The pick-up head as defined in claim 1 wherein the cross-sectional area of the said air pressure chamber means volume decreases progressively in a tapering fashion.

5. The pick-up head as defined in claim 4 wherein said air outlet orifice is generally larger in size at said air pressure chamber means second end portion than at said air pressure chamber means first end portion.

6. The pick-up head as defined in claim 1 wherein said air suction chamber means second end portion defines an air outlet, said air suction chamber means defines an elongated volume corresponding in length generally to said air inlet orifice, the the cross-sectional area of said volume of said air suction chamber means generally decreases in size from said air outlet toward said air suction chamber means first end portion thereby creating air flow over the length of said air inlet orifice, and said air suction chamber means volume decreases progressively in a tapering fashion.

7. A pick-up head adapted for movement along a predetermined path of travel for removing debris therealong comprising means for defining an elongated air outlet orifice through which air is caused to travel, means for defining an elongated air inlet orifice into which air and debris are drawn upon movement of the pick-up head along the predetermined path of travel, said air outlet orifice and air inlet orifice being disposed generally transverse to the predetermined path of travel, air pressure chamber means extending along said air outlet orifice for directing air under pressure to, along and through said air outlet orifice, air suction chamber means extending along said air inlet orifice for drawing air and debris into, and through and along said air inlet orifice, said air pressure chamber means and air outlet orifice each having generally opposite first and second end portions, said first end portions being generally adjacent each other and being generally spaced from their respective second end portions, said air pressure chamber means first end portion defining an air inlet, said air pressure chamber means defining an elongated volume corresponding in length generally to said air outlet orifice, the cross-sectional area of said volume of said air pressure chamber means generally decreases in size from said air inlet toward said air pressure chamber means second end portion thereby creating air flow over the length of said air outlet orifice, and said air outlet orifice is generally larger in size at said air pressure chamber means second end portion than at said air pressure chamber chamber means first end portion.

8. The pick-up head as defined in claim 7 wherein said air outlet orifice tapers convergingly in a direction toward said air pressure chamber means first end portion.

9. The pick-up head as defined in claim 1 including means for varying the size of said air outlet orifice.

10. A pick-up head adapted for movement along a predetermined path of travel for removing debris therealong comprising means for defining an elongated air outlet orifice through which air is caused to travel, means for defining an elongated air inlet orifice into which air and debris are drawn upon movement of the pick-up head along the predetermined path of travel, said air outlet orifice and air inlet orifice being disposed generally transverse to the predetermined path of travel, air pressure chamber means extending along said air outlet orifice for directing air under pressure to, along and through said air outlet orifice, air suction chamber means extending along said air inlet orifice for drawing air and debris into, through and along said air inlet orifice, said air pressure chamber means and air outlet orifice each having generally opposite first and second end portions, said first end portions being generally adjacent each other and being generally spaced from their respective second end portions, said air pressure chamber means first end portion defining an air inlet, said air pressure chamber means defining an elongated volume corresponding in length generally to said air outlet orifice, the the cross-sectional area of said volume of said air pressure chamber means generally decreases in size from said air inlet toward said air pressure chamber means second end portion thereby creating air flow over the length of said air outlet orifice, and means for varying the transverse size of said air outlet orifice.

11. A pick-up head adapted for movement along a predetermined path of travel for removing debris therealong comprising means for defining an elongated air outlet orifice through which air is caused to travel, means for defining an elongated air inlet orifice into which air and debris are drawn upon movement of the pick-up head along the predetermined path of travel, said air outlet orifice and air inlet orifice being disposed generally transverse to the predetermined path of travel, air pressure chamber means extending along said air outlet orifice for directing air under pressure to, along and through said air outlet orifice, air suction chamber means extending along said air inlet orifice for drawing air and debris into, through and along said air inlet orifice, said air pressure chamber means and air outlet orifice each having generally opposite first and second end portions, said first end portions being generally adjacent each other and being generally spaced from their respective second end portions, said air pressure chamber means first end portion defining an air inlet, said air pressure chamber means defining an elongated volume corresponding in length generally to said air outlet orifice, the the cross-sectional area of said volume of said air pressure chamber means generally decreases in size from said air inlet toward said air pressure chamber means second end portion thereby creating air flow over the length of said air outlet orifice, and means for varying the shape of said air outlet orifice.

12. A pick-up head adapted for movement along a predetermined path of travel for removing debris therealong comprising means for defining an elongated air outlet orifice through which air in caused to travel, means for defining an elongated air inlet orifice into which air and debris are drawn upon movement of the pick-up head along the predetermined path of travel, said air outlet orifice and air inlet orifice being disposed generally transverse to the predetermined path of travel, air pressure chamber means extending along said air outlet orifice for directing air under pressure to, along and through said air outlet orifice, air suction chamber means extending along said air inlet orifice for drawing air and debris into, through and along said air inlet orifice, said air pressure chamber means and air outlet orifice each having generally opposite first and second end portions, said first end portions being generally adjacent each other and being generally spaced from their respective second end portions, said air pressure chamber means first end portion defining an air inlet, said air pressure chamber means defining an elongated volume corresponding in length generally to said air outlet orifice, the the cross-sectional area of said volume of said air pressure chamber means generally decreases in size from said air inlet toward said air pressure chamber means second end portion thereby creating air flow over the length of said air outlet orifice, and means for varying the shape of said air outlet orifice between polygonal and triangular.

13. The pick-up head as defined in claim 1 wherein said air outlet orifice is defined at least in part by an elongated flexible member.

14. The pick-up head as defined in claim 1 wherein said air outlet orifice is defined at least in part by an elongated flexible member defining a trailing edge portion of said air outlet orifice as viewed with respect to a forward direction of travel along the path of travel.

15. The pick-up head as defined in claim 1 including a generally flat transition surface between generally said air outlet orifice and said air inlet orifice.

16. The pick-up head as defined in claim 1 including a generally flat transition surface between generally said air outlet orifice and said air inlet orifice, said air outlet orifice and air inlet orifice have respective leading and trailing edge portions as viewed with respect to a forward direction of travel along the path of travel, and said transition surfaced generally spans the distance between said leading and trailing edge portions.

17. The pick-up head as defined in claim 1 including a generally flat horizontal transition surface between generally said air outlet orifice and said air inlet orifice.

18. A pick-up head adapted for movement along a predetermined path of travel for removing debris therealong comprising means for defining an elongated air outlet orifice through which air is caused to travel, means for defining an elongated air inlet orifice into which air and debris are drawn upon movement of the pick-up head along the predetermined path of travel, said air outlet orifice and air inlet orifice being disposed generally transverse to the predetermined path of travel, air pressure chamber means extending along said air outlet orifice for directing air under pressure to, along and through said air outlet orifice, air suction chamber means extending along said air inlet orifice for drawing air and debris into, through and along said air inlet orifice, said air pressure chamber means and air outlet orifice each having generally opposite first and second end portions, said first end portions being generally adjacent each other and being generally spaced from their respective second end portions, said air pressure chamber means first end portion defining an air inlet, said air pressure chamber means defining an elongated volume corresponding in length generally to said air outlet orifice, the the cross-sectional area of said volume of said air pressure chamber means generally decreases in size from said air inlet toward said air pressure chamber means second end portion thereby creating air flow over the length of said air outlet orifice, wall means for establishing an air flow chamber between said air outlet orifice and air inlet orifice through which air flows generally in the forward direction of travel along the path of travel, and means in said wall means for placing said air flow chamber in fluid communication with the exterior.

19. The pick-up head as defined in claim 18 wherein said fluid communication means includes valve means for selectively placing said air flow chamber in fluid communication with the exterior.

20. The pick-up head as defined in claim 18 wherein said fluid communication means includes a hole through which debris atop and exteriorly of said wall means can be flushed.

21. A pick-up head adapted for movement along a predetermined path of travel for removing debris therealong comprising means for defining an elongated air outlet orifice through which air is caused to travel, means for defining an elongated air inlet orifice into which air and debris are drawn upon movement of the pick-up head along the predetermined path of travel, said air outlet orifice and air inlet orifice being disposed generally transverse to the predetermined path of travel, air pressure chamber means extending along said air outlet orifice for directing air under pressure to, along and through said air outlet orifice, air suction chamber means extending along said air inlet orifice for drawing air and debris into, through and along said air inlet orifice, said air pressure chamber means and air outlet orifice each having generally opposite first and second end portions, said first end portions being generally adjacent each other and being generally spaced from their respective second end portions, said air pressure chamber means first end portion defining an air inlet, said air pressure chamber means defining an elongated volume corresponding in length generally to said air outlet orifice, the the cross-sectional area of said volume of said air pressure chamber means generally decreases in size from said air inlet toward said air pressure chamber means second end portion thereby creating air flow over the length of said air outlet orifice, said air suction chamber means second air portion defines an air outlet, said air suction chamber means defines an elongated volume corresponding in length generally to said air inlet orifice, the the cross-sectional area of said volume of said air suction chamber means generally decreases in size from said air outlet toward said air suction chamber means first end portion thereby creating air flow over the length of said air inlet orifice, and said air outlet orifice is generally larger in size at said air pressure chamber means second end portion than at said air pressure chamber means first end portion.

22. The pick-up head as defined in claim 21 wherein said air outlet orifice tapers convergingly in a direction toward said air pressure chamber means first end portion.

23. A pick-up head adapted for movement along a predetermined path of travel for removing debris therealong comprising means for defining an elongated air outlet orifice through which air is caused to travel, means for defining an elongated air inlet orifice into which air and debris are drawn upon movement of the pick-up head along the predetermined path of travel, said air outlet orifice and air inlet orifice being disposed generally transverse to the predetermined path of travel, air pressure chamber means extending along said air outlet orifice for directing air under pressure to, along and through said air outlet orifice, air suction chamber means extending along said air inlet orifice for drawing air and debris into, through and along said air inlet orifice, said air pressure chamber means and air outlet orifice each having generally opposite first and second end portions, said first end portions being generally adjacent each other and being generally spaced from their respective second end portions, said air pressure chamber means first end portion defining an air inlet, said air pressure chamber means defining an elongated volume corresponding in length generally to said air outlet orifice, the the cross-sectional area of said volume of said air pressure chamber means generally decreases in size from said air inlet toward said air pressure chamber means second end portion thereby creating air flow over the length of said air outlet orifice, said air suction chamber means second air portion defines an air outlet, said air suction chamber means defines an elongated volume corresponding in length generally to said air inlet orifice, the the cross-sectional area of said volume of said air suction chamber means generally decreases in size from said air outlet toward said air suction chamber means first end portion thereby creating air flow over the length of said air inlet orifice, and means for varying the shape of said air outlet orifice.

24. A pick-up head adapted for movement along a predetermined path of travel for removing debris therealong comprising means for defining an elongated air outlet orifice through which air is caused to travel, means for defining an elongated air inlet orifice into which air and debris are drawn upon movement of the pick-up head along the predetermined path of travel, said air outlet orifice and air inlet orifice being disposed generally transverse to the predetermined path of travel, air pressure chamber means extending along said air outlet orifice for directing air under pressure to, along and through said air outlet orifice, air suction chamber means extending along said air inlet orifice for drawing air and debris into, through and along said air inlet orifice, said air pressure chamber means and air outlet orifice each having generally opposite first and second end portions, said first end portions being generally adjacent each other being generally spaced from their respective second end portions, said air pressure chamber means first end portion defining an air inlet, said air pressure chamber means defining an elongated volume corresponding in length generally to said air outlet orifice, the the cross-sectional area of said volume of said air pressure chamber means generally decreases in size from said air inlet toward said air pressure chamber means second end portion thereby creating air flow over the length of said air outlet orifice, said air suction chamber means second air portion defines an air outlet, said air suction chamber means defines an elongated volume corresponding in length generally to said air inlet orifice, the the cross-sectional area of said volume of said air suction chamber means generally decreases in size from said air outlet toward said air suction chamber means first end portion thereby creating air flow over the length of said air inlet orifice, and means for varying the shape of said air outlet orifice between polygonal and triangular.

25. A pick-up head adapted for movement along a predetermined path of travel for removing debris therealong comprising means for defining an elongated air outlet orifice through which air is caused to travel, means for defining an elongated air inlet orifice into which air and debris are drawn upon movement of the pick-up head along the predetermined path of travel, said air outlet orifice and air inlet orifice being disposed generally transverse to the predetermined path of travel, air pressure chamber means extending along said air outlet orifice for directing air under pressure to, along and through said air outlet orifice, air suction chamber means extending along said air inlet orifice for drawing air and debris into, through and along said air inlet orifice, said air pressure chamber means and air outlet orifice each having generally opposite first and second end portions, said first end portions being generally adjacent each other and being generally spaced from their respective second end portions, said air pressure chamber means first end portion defining an air inlet, said air pressure chamber means defining an elongated volume corresponding in length generally to said air outlet orifice, the volume of said air pressure chamber means generally decreases in size from said air inlet toward said air pressure chamber means second end portion thereby creating air flow over the length of said air outlet orifice, said air suction chamber means second air portion defines an air outlet, said air suction chamber means defines an elongated volume corresponding in length generally to said air inlet orifice, the the cross-sectional area of said volume of said air suction chamber means generally decreases in size from said air outlet toward said air suction chamber means first end portion thereby creating air flow over the length of said air inlet orifice, and means for varying the size of said air inlet orifice.

26. A pick-up head adapted for movement along a predetermined path of travel for removing debris therealong comprising means for defining an elongated air outlet orifice through which air is caused to travel, means for defining an elongated air inlet orifice into which air and debris are drawn upon movement of the pick-up head along the predetermined path of travel, said air outlet orifice and air inlet orifice being disposed generally transverse to the predetermined path of travel, air pressure chamber means extending along said air outlet orifice for directing air under pressure to, along and through said air outlet orifice, air suction chamber means extending along said air inlet orifice for drawing air and debris into, through and along said air inlet orifice, said air pressure chamber means and air outlet orifice each having generally opposite first and second end portions, said first end portions being generally adjacent each other and being generally spaced from their respective second end portions, said air pressure chamber means first end portion defining an air inlet, said air pressure chamber means defining an elongated volume corresponding in length generally to said air outlet orifice, the the cross-sectional area of said volume of said air pressure chamber means generally decreases in size from said air inlet toward said air pressure chamber means second end portion thereby creating air flow over the length of said air outlet orifice, said air suction chamber means second air portion defines an air outlet, said air suction chamber means defines an elongated volume corresponding in length generally to said air inlet orifice, the the cross-sectional area of said volume of said air suction chamber means generally decreases in size from said air outlet toward said air suction chamber means first end portion thereby creating air flow over the length of said air inlet orifice, and means for varying the transverse size of said air inlet orifice.

27. A pick-up head adapted for movement along a predetermined path of travel for removing debris therealong comprising means for defining an elongated air outlet orifice through which air is caused to travel, means for defining an elongated air inlet orifice into which air and debris are drawn upon movement of the pick-up head along the pedetermined path of travel, said air outlet orifice and air inlet orifice being disposed generally transverse to the predetermined path of travel, air pressure chamber means extending along said air outlet orifice for directing air under pressure to, along and through said air outlet orifice, air suction chamber means extending along said air inlet orifice for drawing air and debris into, through and along said air inlet orifice, said air pressure chamber means and air outlet orifice each having generally opposite first and second end portions, said first end portions being generally adjacent each other and being generally spaced from their respective second end portions, said air pressure chamber means first end portion defining an air inlet, said air pressure chamber means defining an elongated volume corresponding in length generally to said air outlet orifice, the the cross-sectional area of said volume of said air pressure chamber means generally decreases in size from said air inlet toward said air pressure chamber means second end portion thereby creating air flow over the length of said air outlet orifice, the cross-sectional area of said said air pressure chamber means volume decreases progressively in a tapering fashion, said air outlet orifice being generally larger in size at said air pressure chamber means second end portion than at said air pressure chamber means first end portion, and said air outlet orifice tapers convergingly in a direction toward said air pressure chamber means first end portion.

28. A pick-up head adapted for movement along a predetermined path of travel for removing debris therealong comprising means for defining an elongated air outlet orifice through which air is caused to travel, means for defining an elongated air inlet orifice into which air and debris are drawn upon movement of the pick-up head along the predetermined path of travel, said air outlet orifice and air inlet orifice being disposed generally transverse to the predetermined path of travel, air pressure chamber means extending along said air outlet orifice for directing air under pressure to, along and through said air outlet orifice, air suction chamber means extending along said air inlet orifice for drawing air and debris into, through and along said air inlet orifice, said air pressure chamber means and air outlet orifice each having generally opposite first and second end portions, said first end portions being generally adjacent each other and being generally spaced from their respective second end portions, said air pressure chamber means first end portion defining an air inlet, said air pressure chamber means defining an elongated volume corresponding in length generally to said air outlet orifice, the the cross-sectional area of said volume of said air pressure chamber means generally decreases in size from said air inlet toward said air pressure chamber means second end portion thereby creating air flow over the length of said air outlet orifice, said air outlet orifice is generally larger in size at said air pressure chamber means second end portion than at said air pressure chamber means first end portion, and means for varying the shape of said air outlet orifice between polygonal and triangular.

29. A pick-up head adapted for movement along a predetermined path of travel for removing debris therealong comprising means for defining an elongated air outlet orifice through which air is caused to travel, means for defining an elongated air inlet orifice into which air and debris are drawn upon movement of the pick-up head along the predetermined path of travel, said air outlet orifice and air inlet orifice being disposed generally transverse to the predetermined path of travel, air pressure chamber means extending along said air outlet orifice for directing air under pressure to, along and through said air outlet orifice, air suction chamber means extending along said air inlet orifice for drawing air and debris into, through and along said air inlet orifice, said air pressure chamber means and air outlet orifice each having generally opposite first and second end portions, said first end portions being generally adjacent each other and being generally spaced from their respective second end portions, said air pressure chamber means first end portion defining an air inlet, said air pressure chamber means defining an elongated volume corresponding in length generally to said air outlet orifice, the the cross-sectional area of the volume of said air pressure chamber means generally decreases in size from said air inlet toward said air pressure chamber means second end portion thereby creating air flow over the length of said air outlet orifice, said air outlet orifice is generally larger in size at said air pressure chamber means second end portion than at said air pressure chamber means first end portion, and a generally flat transition surface between generally said air outlet orifice and said air inlet orifice.

30. A pick-up head adapted for movement along a predetermined path of travel for removing debris therealong comprising means for defining an elongated air outlet orifice through which air is caused to travel, means for defining an elongated air inlet orifice into which air and debris are drawn upon movement of the pick-up head along the predetermined path of travel, said air outlet orifice and air inlet orifice being disposed generally transverse to the predetermined path of travel, air pressure chamber means extending along said air outlet orifice for directing air under pressure to, along and through said air outlet orifice, air suction chamber means extending along said air inlet orifice for drawing air and debris into, through and along said air inlet orifice, said air pressure chamber means and air outlet orifice each having generally opposite first and second end portions, said first end portions being generally adjacent each other and being generally spaced from their respective second end portions, said air pressure chamber means having an air inlet, said air suction chamber means second end portion defining an air outlet, said air suction chamber means defining an elongated volume corresponding in length generally to said air inlet orifice, said pressure chamber means and air outlet orifice being disposed generally entirely at one side of a plane through said pick-up head which is normal to the predetermined path of travel, said air suction chamber means and air inlet orifice being disposed generally entirely at a second side of said last-mentioned plane opposite said one side, and the the cross-sectional area of said volume of said air suction chamber means generally decreases in size from said air outlet toward said air suction chamber means first end portion thereby creating air flow over the length of said air inlet orifice.

31. The pick-up head as defined in claim 30 wherein the cross-sectional area of the said air suction chamber means volume decreases progressively in a tapering fashion.

32. A pick-up head adapted for movement along a predetermined path of travel for removing debris therealong comprising means for defining an elongated air outlet orifice through which air is caused to travel, means for defining an elongated air inlet orifice into which air and debris are drawn upon movement of the pick-up head along the predetermined path of travel, said air outlet orifice and air inlet orifice being disposed generally transverse to the predetermined path of travel, air pressure chamber means extending along said air outlet orifice for directing air under pressure to, along and through said air outlet orifice, air suction chamber means extending along said air inlet orifice for drawing air and debris into, through and along said air inlet orifice, said air pressure chamber means and air outlet orifice each having generally opposite first and second end portions, said first end portions being generally adjacent each other and being generally spaced from their respective second end portions, said air pressure chamber means having an air inlet, said air suction chamber means second end portion defining an air outlet, said air suction chamber means defining an elongated volume corresponding in length generally to said air inlet orifice, the the cross-sectional area of said volume of said air suction chamber means generally decreases in size from said air outlet toward said air suction chamber means first end portion thereby creating air flow over the length of said air inlet orifice, and means for varying the size of said air inlet orifice.

33. A pick-up head adapted for movement along a predetermined path of travel for removing debris therealong comprising means for defining an elongated air outlet orifice through which air is caused to travel, means for defining an elongated air inlet orifice into which air and debris are drawn upon movement of the pick-up head along the predetermined path of travel, said air outlet orifice and air inlet orifice being disposed generally transverse to the predetermined path of travel, air pressure chamber means extending along said air outlet orifice for directing air under pressure to, along and through said air outlet orifice, air suction chamber means extending along said air inlet orifice for drawing air and debris into, through and along said air inlet orifice, said air pressure chamber means and air outlet orifice each having generally opposite first and second end portions, said first end portions being generally adjacent each other and being generally spaced from their respective second end portions, said air pressure chamber means having an air inlet, said air suction chamber means second end portion defining an air outlet, said air suction chamber means defining an elongated volume corresponding in length generally to said inlet orifice, the the cross-sectional area of said volume of said air suction chamber means generally decreases in size from said air outlet toward said air suction chamber means first end portion thereby creating air flow over the length of said air inlet orifice, and means for varying the transverse size of said air inlet orifice.

34. A pick-up head adapted for movement along a predetermined path of travel for removing debris therealong comprising means for defining an elongated air outlet orifice through which air is caused to travel, means for defining an elongated air inlet orifice into which air and debris are drawn upon movement of the pick-up head along the predetermined path of travel, said air outlet orifice and air inlet orifice being disposed generally transverse to the predetermined path of travel, air pressure chamber means extending along said air outlet orifice for directing air under pressure to, along and through said air outlet orifice, air suction chamber means extending along said air inlet orifice for drawing air and debris into, through and along said air inlet orifice, said air pressure chamber means and air outlet orifice each having generally opposite first and second end portions, said first end portions being generally adjacent each other and being generally spaced from their respective second end portions, said air pressure chamber means having an air inlet, said air suction chamber means second end portion defining an air outlet, said air suction chamber means defining an elongated volume corresponding in length generally to said air inlet orifice, the the cross-sectional area of the volume of said air suction chamber means generally decreases in size from said air outlet toward said air suction chamber means first end portion thereby creating air flow over the length of said air inlet orifice, and means for slidably adjusting at least a portion of said air inlet orifice generally transversely of the longitudinal axis thereof thereby adjusting the air inlet orifice size.

35. A pick-up head comprising a generally elongated air pressure chamber, a generally elongated air suction chamber, said air pressure and air suction chambers each having opposite first and second end portions, said chambers being in side-by-side adjacent relationship to each other and being disposed with longitudinal axes thereof generally transverse to the direction of travel of the pick-up head, said air pressure and air suction chambers first end portions being adjacent each other and remote from each one's second end portion, an elongated air suction orifice associated with said air suction chamber, an elongated air pressure orifice associated with said air pressure chamber, said air pressure orifice and air pressure chamber being of generally commensurate length, said air suction orifice and air suction chamber being of generally commensurate length, an air inlet for delivering air into said air pressure chamber, an air outlet for removing air and debris from said air suction chamber, said pressure chamber and air pressure orifice being disposed generally entirely at one side of a plane through said pick-up head which is normal to said direction of travel, said air suction chamber and air suction orifice being disposed generally entirely at a second side of said last-mentioned plane opposite said one side, and said air inlet and air outlet being disposed generally at opposite sides of a vertical plane generally transverse to the direction of travel.

36. The pick-up head as defined in claim 35 wherein the cross-sectional area of each of said volumes decreases progressively in a tapering fashion.

37. A pick-up head comprising a generally elongated air pressure chamber, a generally elongated air suction chamber, said air pressure and air suction chambers each having opposite first and second end portions, said chambers being in side-by-side adjacent relationship to each other and being disposed with longitudinal axes thereof generally transverse to the direction of travel of the pick-up head, said air pressure and air suction chambers first end portions being adjacent each other and remote from each one's second end portion, an elongated air suction orifice associated with said air suction chamber, an elongated air pressure orifice associated with said air pressure chamber, said air pressure orifice and air pressure chamber being of generally commensurate length, said air suction orifice and air suction chamber being of generally commensurate length, an air inlet for delivering air into said air pressure chamber, an air outlet for removing air and debris from said air suction chamber, said air inlet and air outlet being disposed generally at opposite sides of a vertical plane generally transverse to the direction of travel, and means for defining a hole in said pickup head through which debris atop and exteriorly thereof can be flushed.

38. A pick-up head adapted for movement along a predetermined path of travel for removing debris therealong comprising means for defining an elongated air outlet orifice through which air is caused to travel, means for defining an elongated air inlet orifice into which air and debris are drawn upon movement of the pick-up head along the predetermined path of travel, said air outlet orifice and air inlet orifice being disposed generally transverse to the predetermined path of travel, air pressure chamber means extending along said air outlet orifice for directing air under pressure to, along and through said air outlet orifice, air suction chamber means extending along said air inlet orifice for drawing air and debris into, through and along said air inlet orifice, said air pressure chamber means and air outlet orifice each having generally opposite first and second end portion, said first end portions being generally adjacent each other and being generally spaced from their respective second end portions, said air pressure chamber means first end portion defining an air inlet, said air pressure chamber means defining an elongated volume corresponding in length generally to said air outlet orifice, and the volume of said air pressure chamber means generally decreases in size from said air inlet toward said air pressure chamber means second end portion thereby creating air flow over the length of said air outlet orifice, a wall between said chambers, opposite side skids at transversely spaced side edges of said wall, said side skids supporting said pick-up head upon a surface to be cleaned in intimately spaced relationship thereto, a pair of opposite longitudinal walls defining with said skids and wall a pick-up head chamber defining a cross-sectional area within which debris is drawn into and through said air suction orifice, and means in said wall through which debris atop said wall can be flushed into said pick-up head chamber.

39. The pick-up head as defined in claim 38 wherein said last-mentioned means is a hole.

40. The pick-up head as defined in claim 38 wherein said last-mentioned means is a hole, and means for selectively closing said hole.

* * * * *